United States Patent [19]

Douglas et al.

[11] 4,195,681

[45] Apr. 1, 1980

[54] FLY SCREENS FOR WINDOWS

[75] Inventors: Jack E. Douglas, Walsall; Richard J. Bigley, Telford, both of England

[73] Assignee: Arthur Shaw Manufacturing Ltd., West Midlands, England

[21] Appl. No.: 868,425

[22] Filed: Jan. 10, 1978

[30] Foreign Application Priority Data

Jan. 12, 1977 [GB] United Kingdom ..... 1072/77

[51] Int. Cl.[2] ..... E06B 9/00

[52] U.S. Cl. ..... 160/371; 160/372; 160/381

[58] Field of Search ..... 160/40, 89, 90, 91, 160/371, 372, 374, 375, 376, 381, 392; 49/488, 493, 494

[56] References Cited

U.S. PATENT DOCUMENTS

| | | | |
|---|---|---|---|
| 1,785,584 | 12/1930 | Higgin | 160/40 |
| 2,042,726 | 6/1936 | Mueller | 160/381 |
| 2,837,153 | 6/1958 | Brown et al. | 160/371 |
| 2,923,351 | 2/1960 | Zitomer | 160/381 |
| 3,211,089 | 10/1965 | Messerschmitt | 160/381 |
| 3,273,633 | 9/1966 | Seidmon et al. | 160/381 |
| 3,411,243 | 11/1968 | Baermann | 49/493 |
| 3,627,359 | 12/1971 | Paul | 160/381 |
| 3,709,533 | 1/1973 | Walters | 160/381 |
| 3,763,596 | 10/1973 | Anderson | 49/493 |

FOREIGN PATENT DOCUMENTS

| | | | |
|---|---|---|---|
| 1037236 | 7/1966 | United Kingdom | 160/392 |

*Primary Examiner*—Peter M. Caun

*Attorney, Agent, or Firm*—Wender, Murase & White

[57] ABSTRACT

A fly screen for windows and doors comprising fly netting extending over one face of a rectangular frame with the marginal edge of the netting located in a recess in the frame and a wedge strip received in the recess over the fly netting to clamp and retain the fly netting in position. The fly screen frame may include mounting means for locating fly screen on an existing door or window frame or the fly screen may include separate mounting means for the frame whereby the fly screen can be mounted to cover an aperture. The fly screen frame comprises four frame elements formed as extrusions of the appropriate section which are cut to length with the adjacent ends being connected by corner cleats so that the fly screen frame can be assembled to suit any size of window or door. The fly netting comprises a material which can be easily cut such as plastic coated fiber-glass.

6 Claims, 6 Drawing Figures

FLY SCREENS FOR WINDOWS

BACKGROUND OF THE INVENTION

1. Field of the Invention

This invention concerns improvements, in, or relating to, fly screens for windows and doors.

2. Description of the Prior Art

It is desirable to provide fly screens which can be fitted to cover that part of the window which can be opened or, in the case of a door, the doorway. Conventionally, a fly screen is fitted to the fixed frame of the window or door, either outside or inside, so that the aperture left by an opened window or door is protected. In the case of sliding windows with one fixed light and one sliding light, the fly screen covers the opening of the sliding light. However this type of window has the disadvantage that the whole window cannot be cleaned from inside the building. With windows having two or more sliding lights, the advantage of being able to clean the window from inside the building is offset by the need to cover the whole window by a fly screen, with the consequent increased cost of same, particularly with large glazed areas, especially as the screen is usually custom made.

SUMMARY OF THE INVENTION

It is an object of the present invention to provide a fly screen that can be assembled from a simple kit and which may be simply located and supported on the fixed frame of the window or door and which can be assembled to accommodate a range of sizes.

According to this invention we provide a fly screen for a window or door comprising a rectangular frame adapted for mounting on the fixed frame of the window or door, the fly screen frame comprising four elongate elements of which the adjacent ends are joined together by corner cleats, the frame including a rebate in which the marginal edge of the fly-netting is clamped by an elongate wedge strip pushed into the rebate over the fly netting so as to close the inner area defined by the frame with fly netting.

The elongate elements are conveniently formed as extrusions of the appropriate cross-section so that the rectangular frame can be assembled to the required size by cutting lengths of the extruded frame elements to the appropriate sizes and then joining the cut lengths together by the corner cleats.

It will be appreciated that the fly screen can be assembled from a simple kit to accommodate a range of sizes of fixed window or door frames simply by cutting lengths of the extruded frame elements and the wedge strip to the required size. In this way the fly screen according to the present invention overcomes the disadvantages of known fly screens which are manufactured to size and cannot be converted to accommodate a range of sizes of fixed window or door frames.

The elongate elements, which in use comprise the upper and lower frame elements and in some cases the corner cleats may be specially adapted for mounting on the fixed frame of the fixed frame of the door or window by providing integral mounting means comprising flanges or rebates extending along the peripheral edge of the assembled fly screen frame. These flanges or rebates are designed to complement the design of the fixed frame so as to enable simple fixing or mounting, such as by dropping into or sliding on the existing guide rails, channel or the like in the fixed frame. The elongate elements which in use comprise the side frame elements are adapted to receive sealing means for sealing the fly screen frame relative to the fixed frame and/or an adjacent glazed sash and are therefore often of different cross-section to the top and bottom frame elements.

Preferably the elongate frame elements are of similar cross-section and the frame further comprises four elongate adaptor members, each adaptor member being located on a respective one of the frame elements. The adaptor members which are located on the upper and lower frame elements include the mounting means which can then be selected so as to vary the outer side edge configuration of the frame to suite the design of any fixed frame. The adaptor members which are located on the side frame elements include locating means for locating and receiving the sealing means. The sealing means preferably comprises a pile strip of wool, neoprene, foamed plastics or any other suitable deformable material secured to one face of a strip.

Preferably the fly-netting is of the flexible type which can be cut easily, for example, a plastic coated fiberglass netting. Additionally, the wedge strip is also preferably flexible and easily cut, and a rubber or elastomeric or plastic strip is suitable for forcing into the rebate.

Conveniently, the elongate elements are formed from extruded metal/alloy such as an aluminium alloy. However, the elongate elements could be plastic coated metal or a suitable plastic material. Separate mounting means may be provided which is suitable for mounting the fly screen frame in an unglazed aperture or to cover a glazed window or door without utilizing the existing frame to hold the fly screen frame in position.

The invention is described in more detail with reference to the accompanying drawings.

DETAILED DESCRIPTION OF THE PREFERRED EMBODIMENTS

Figure 1:
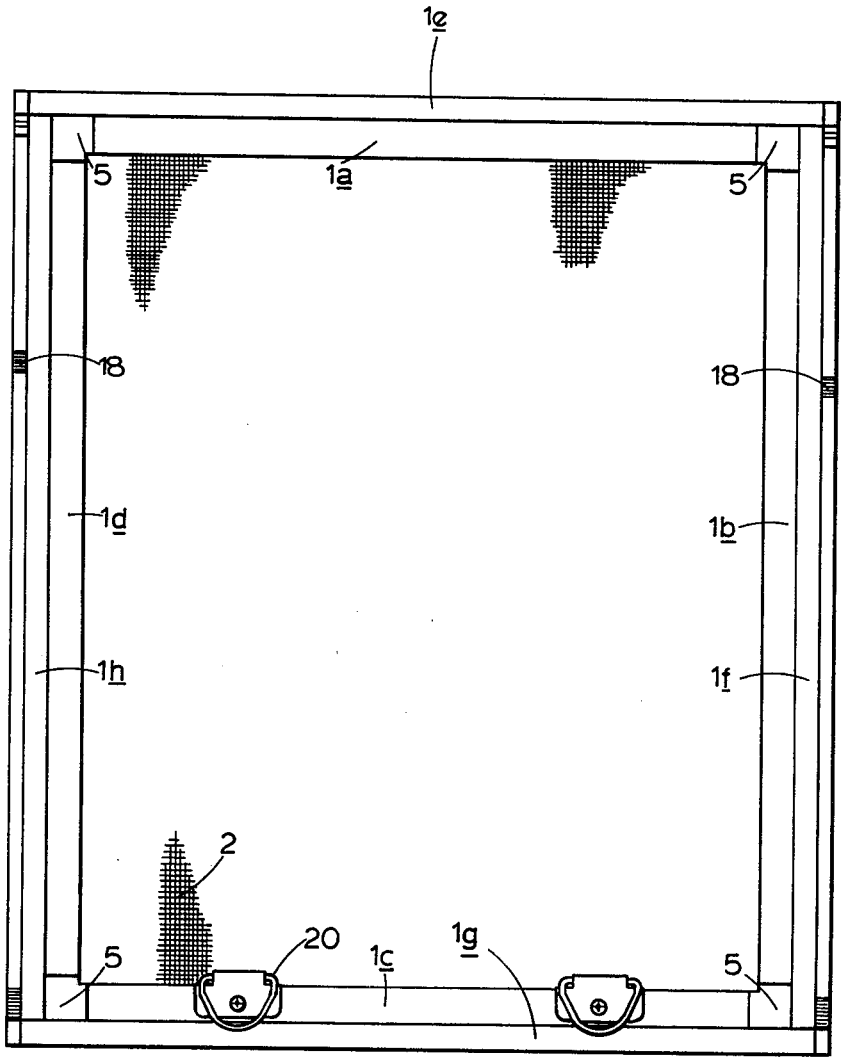
FIG. 1 is a front elevational view of a preferred embodiment of a fly screen according to the present invention.

The fly screen shown in FIGS. 1 to 4 comprises a rectangular frame 1 with fly-netting 2 extending over one face of the frame and a wedge strip 3 received in a rebate 4 in the frame over the marginal edge of the fly-netting so as to clamp and retain the fly-netting in position.

The frame 1 comprises four elongate elements 1*a*, 1*b*, 1*c* and 1*d* of which the adjacent ends are joined together by a respective corner cleat 5. The frame elements 1*a*, 1*b*, 1*c* and 1*d* are similar to each other and are cut to size from an extrusion of aluminium alloy of constant cross-section. Each frame element comprises a main body 6 of generally C-section, defining an undercut channel 7, and an upstanding flange 8 of T-section. The corner cleats 5 which may be die castings or injection mouldings each have two extensions 5a, 5b of generally channel section extending normal to each other. The extensions are received within the channels 7 of the associated frame elements to locate the adjacent ends of the frame elements together. The extensions 5a, 5b each having a pair of longitudinally extending pips or lugs 5c (one only of which is shown) which are deformed during assembly so that the extensions are a tight interference fit in the channel 7 of the associated frame elements. In this way the use of securing screws or other attachment means for the frame elements is avoided. Additionally the corner cleats 5 each have a groove 9 formed in one face and a respective upstanding flange 10 of T-section on each extension 5a, 5b. In the assembled frame the groove 9 is continuous with the channel 7 of the associated frame elements and the upstanding flanges 10 are contiguous with the upstanding flange 8 of the associated frame elements.

The channel 7 of each frame element and the groove 9 of each corner cleat define the above-mentioned rebate 4 in which the marginal edge of the fly-netting 2 is received and clamped in position by the wedge strip 3. The fly-netting 2 is of the flexible type which can be cut easily, for example, a plastic coated fiberglass netting. The wedge strip 3 comprises a flexible rubber or elastomeric or plastic strip which can be cut to size and is suitable for forcing into the rebate 4.

Figure 4:
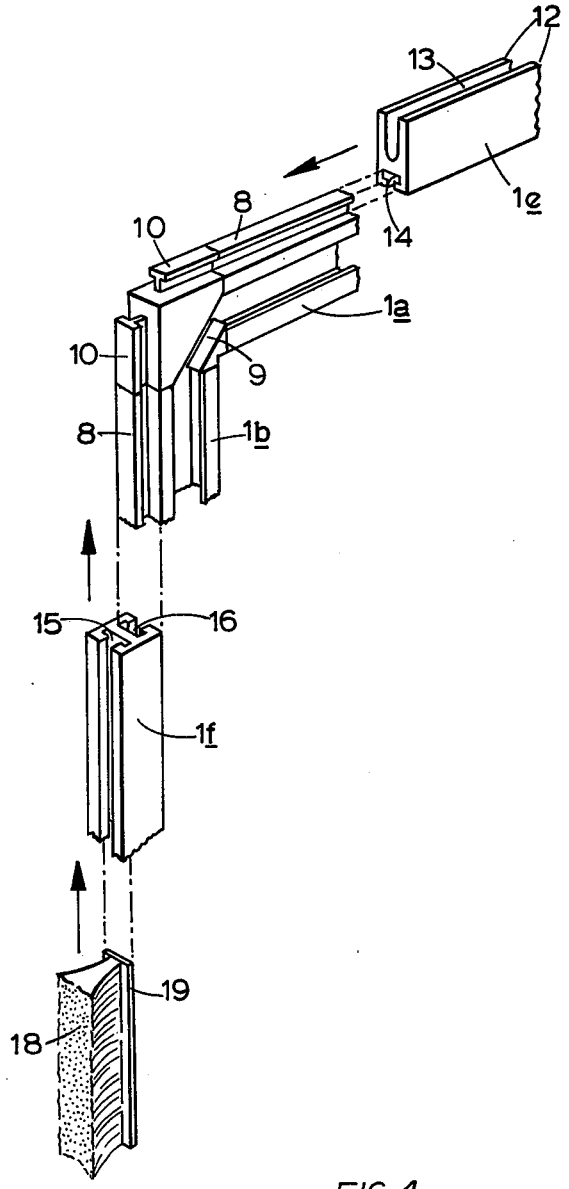
FIG. 4 is an exploded perspective view showing the assembly of the adaptor elements and pile seal.

Frame 1 further includes four elongate adaptor members 1e, 1f, 1g and 1h which are located on the above described upstanding flanges 8, 10 of the frame. The members 1e, 1g are mounted on one pair of opposed frame elements, the upper and the lower elements 1a, 1c, and provide mounting means for mounting the fly screen on a fixed door or window frame. The members 1f and 1h are mounted on the other pair of opposed frame elements, the side elements 1b, 1d, and provide locating means for receiving and locating sealing means 11 for sealing the fly screen relative to the fixed door or window frame and/or an adjacent glazed sash. The adaptor members 1e and 1g are similar to each other and each has an outwardly extending pair of flanges 12 which define an open channel section 13 and a longitudinally extending groove 14 of T-section complementary to the upstanding flanges 8, 10 of the frame so that the members can be slid onto the frame as shown in FIG. 4. The adaptor members 1f and 1h are also similar to each other and each has a longitudinally extending groove 15 of T-section in one face and a longitudinally extending groove 16 of T-section complementary to the flanges 8, 10 of the frame in the opposed face so that the members can be slid onto the frame 1 as shown in FIG. 4. The adaptor members 1e, 1f, 1g and 1h all comprise extrusions of aluminium alloy of the appropriate section which is cut to length. Screws 17 are provided for securing the adaptor members in position. The sealing means 11 comprises a pile 18 of wool, neoprene, foamed plastic or similar deformable material secured to one side of a strip 19. The strip 19 is located in the groove 15 of the adaptor members 1f and 1h and is slid into position as shown in FIG. 4. One or more lifting rings 20 are secured to the frame elements 1c to facilitate both the locating of the frame in position and the subsequent lifting and removal of the frame.

Figure 2:
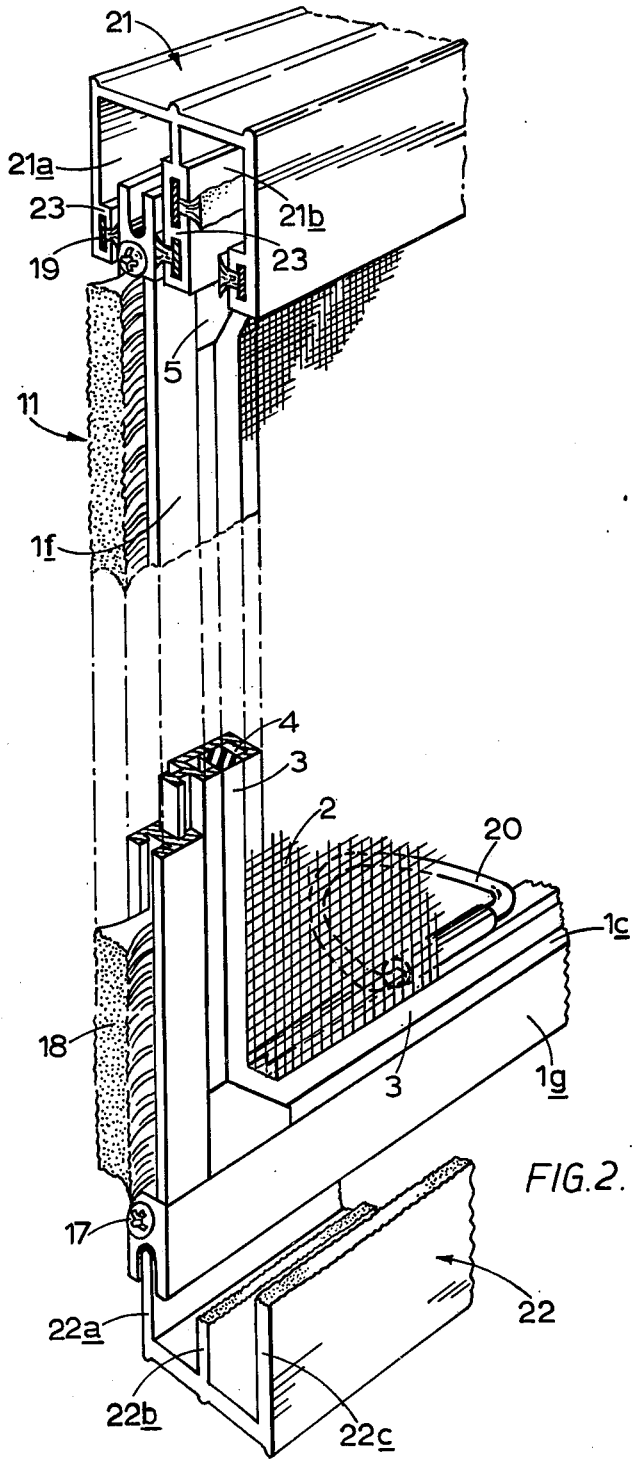
FIG. 2 is a perspective rear view of the top and bottom corners of one end of the fly screen shown in FIG. 1 and showing the mounting of the fly screen on a fixed frame.
Figure 3:
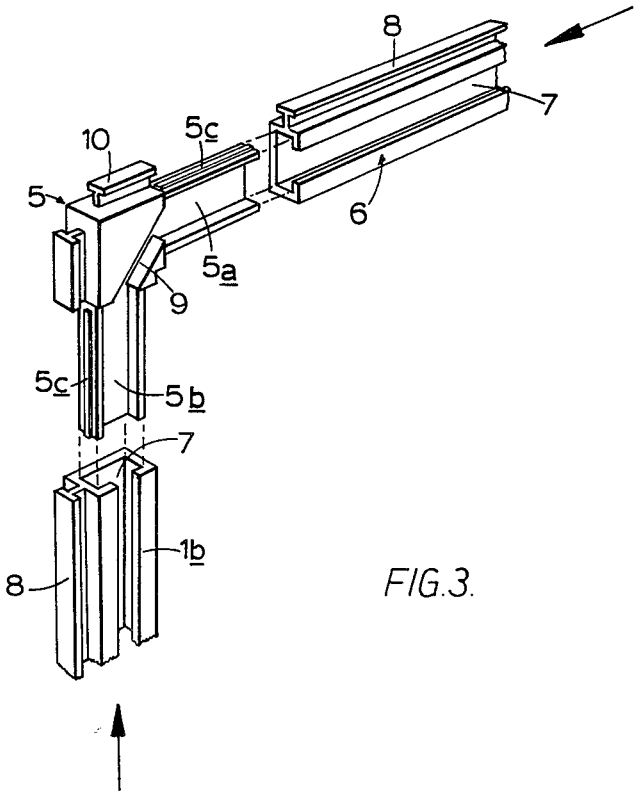
FIG. 3 is an exploded perspective view of one corner of the fly screen frame.

The above described fly screen is suitable for mounting in the fixed frame of a window comprising one or more sliding lights. The upper and lower guide rails or runners 21 and 22 respectively of such a fixed frame are shown in FIG. 2. The upper guide rail 21 comprises two adjacent channel sections 21a, 21b extending parallel to each other. The opposed faces of each channel section are formed with a respective longitudinally extending groove 23 in which pile strip 19 is located. The lower guide rail 22 has three upstanding flanges 22a, 22b and 22c extending parallel to each other. The flanges 22a, and 22c provide runners for respective sliding glazed sashes (not shown) the upper ends of which are received between the facing pile strips of the associated channel sections 21a and 21b. In use of the fly screen a glazed sash (not shown) is slid to one side and the upper adaptor member 1e is inserted between the facing pile strips of channel section 21a until the lower adaptor member 1g can be lowered with its open channel section 13 onto the flange 22a. In position the pile strip 19 mounted on the side adaptor members 1f, 1h seals the fly screen relative to the fixed window frame and the adjacent sliding glazed sash.

It will be appreciated that because the fly screen actually locates on, and is supported by, the existing window frame, when the fly screen is fitted in place the sliding sash in the typical window described above is maintained open by the interference of the fly screen. Thus with a fly screen according to the invention, the window of the typical kind described above does not have to be modified to take the fly screen, nor does the fly screen have to be factory assembled to a predetermined size. Furthermore, opening-closing movement of the sash can be achieved once the fly screen is removed, for example for cleaning.

It will be appreciated that the invention is not limited to the particular shape and construction of the frame elements, corner cleats and adaptor members described above. Thus where the frame elements and adaptor members are provided with interengageable formations comprising complementary T-section flanges and grooves which allow a sliding fit between the components as well as locking the components together it will be understood that the flanges and grooves are interchangeable or may even be replaced by any other suitable interengageable complementary formations. Additionally the groove 9 and/or the upstanding flanges 10 provided on the corner cleats may be omitted. When the groove 9 is omitted it will be appreciated that the rebate 4 comprises the respective channel 7 of each frame element and that a respective wedge strip 3 is cut to size for insertion in each channel 7.

Figure 5:
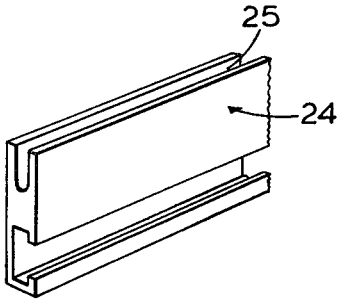
FIG. 5 is a perspective view of a modified frame element.

The adaptor members 1e and 1g which provide the mounting means can be selected so as to complement the design of the fixed frame. However in a modification illustrated in FIG. 5 the frame elements 1a and 1c and the corresponding adaptor members 1e and 1g are combined in a single component 24 in which the mounting means comprises a channel section 25 integral with the frame element. The component 24 is also formed as an extrusion of aluminium alloy. Likewise the side elements 1b and 1d and the corresponding adaptor members 1f and 1h may also be combined to give a single component which is formed as an extrusion of aluminium alloy. In yet another modification when the fly screen is intended for mounting in a door frame it is envisaged that the fly screen frame would be provided with support rollers or guides to provide improved sliding movement of the frame on the upstanding flanges defining the runners. It will also be understood that while the frame elements and adaptor members have been described as extrusions of aluminium alloy they may in fact comprise extrusions of any other suitable metal/alloy, a plastic coated metal, or even a suitable plastic material. Cover beads or trims may be provided to cover the wedge strip and prevent interference.

In the above described embodiments the mounting means comprising an open channel is provided on each of a pair of opposed frame elements or adaptor members so that either component could be mounted on the lower guide rail with the other component being received between the pile strip in the upper channel section. It will be appreciated therefore that the mounting means may only be provided on one of the components. Furthermore, although the mounting means has been described as an open channel which is located on an upstanding flange of the fixed frame it will be appreciated that the mounting means may comprise any suitable locating formations which complement the design of the fixed frame.

Figure 6:
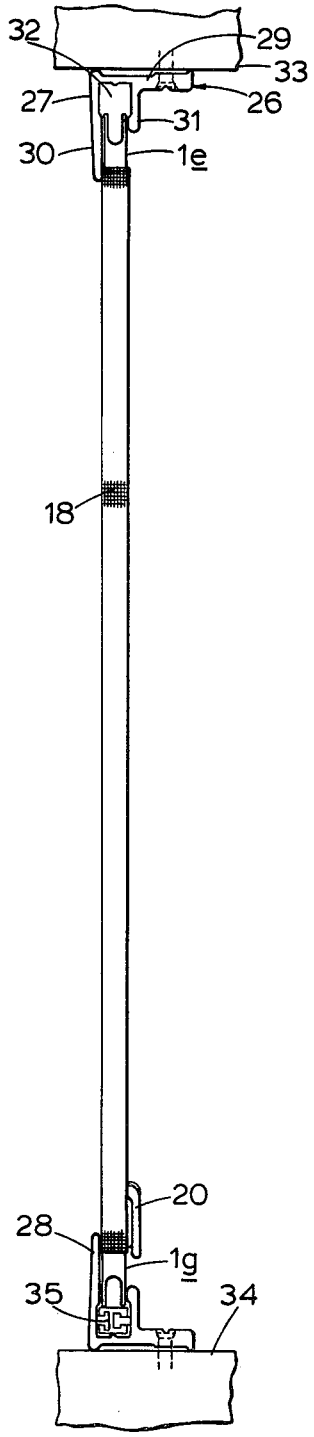
FIG. 6 is an end elevational view showing separate mounting means for the fly screen frame shown in FIG. 1.

FIG. 6 illustrates alternative mounting means 26 for mounting the above described fly screen comprising upper and lower members 27, 28 respectively of similar cross-section. Each member comprises a base 29 an outer or face flange 30 and an inner flange 31 which is shallower than the face flange 30 and extends parallel to the face flange to define a channel section recess 32. The members 27, 28 are formed as an extrusion, preferably of aluminium alloy and are cut to size to correspond to the width of the aperture to be covered. In use the upper member 27 is secured along the upper face 33 of the aperture to be covered. An insert 35 is located in the recess 32 of the lower member 28 and the lower member is secured along the lower face 34 of the aperture. The configuration of the recess 32 and the insert 35 are selected so that the insert has to be slid longitudinally into the recess and cannot be removed once the lower member is in position. Preferably the insert comprises a length of the extrusion from which the above-described adaptor members **1*f* and 1*h* are formed. Once the members 27, 28 are in position the upper adaptor member 1*e* is inserted into the recess 32 in the upper member 27 allowing the lower adaptor member 1*g* to pass over the inner flange 31 of the lower member 28 whereupon the fly screen frame is lowered so that the lower adaptor member is seated on the insert 35 while the upper adaptor member is still retained within the recess 32 of the upper member 27**.

It will be appreciated that the mounting means 26 is particularly suited for mounting the fly screen in an unglazed aperture or to cover a glazed door or window without utilizing the door or window frame to hold the fly screen frame in position. It will also be understood that although the mounting means 26 has been described for mounting a fly screen frame which includes mounting means on the fly screen frame itself suitable for mounting the fly screen frame on an existing window frame the mounting means 26 could be used for mounting a fly screen frame which is not adapted for mounting on an existing window frame.

Finally it will be appreciated from the foregoing that the fly screen according to the invention may be sold as a kit for a designated maximum size of frame and the parts may be cut to length to suit the particular frame size. A range of such maximum sizes could even be provided.

We claim:

1. A fly screen for a fixed frame comprising four elongate elements joined together by respective corner cleats to form a screen frame, means on the elongate elements for mounting the screen frame on the fixed frame, a rebate extending length-wise of each of said elongate elements on one face thereof, and each said corner cleat having a rigid body with a rebate formed therein, said rebate of each of said corner cleats extending contiguously with each said rebate in adjacent frame elements so as to extend between and join said adjacent rebates of said adjacent frame members at an obtuse angle to form in said one face of said screen frame a continuous groove extending around said screen frame, fly-netting extending over said one face of said screen frame and the marginal edge of said fly-netting extending into said groove and retained therein by an elongate wedging member comprising a strip of flexible and resilient material extending into said continuous groove whereby said wedging member is in continuous engagement with said marginal edge of said netting entirely around said one face of said screen frame, said elongate frame elements each being of similar cross-section and said screen frame further comprising four elongate adaptor members each mounted on a respective one of said frame elements by interengagable lengthwise complementary formations, said formations including T-shaped grooves and T-shaped flanges whereby said adaptor member can be mounted on said frame elements by relative sliding movement.

2. A fly screen according to claim 1 wherein said corner cleat body has side edges extending contiguously with adjacent side edges of said frame elements, and said side edges of said cleat body are formed with T-shaped flanges for complementary engagement with T-shaped grooves in said adaptor members.

3. A fly screen according to claim 2 wherein said adaptor members are secured against movement relative to said frame elements by screw means engaging an adjacent cleat body.

4. A fly screen according to claim 3 wherein two opposed adaptor members are provided with sealing means comprising strips carrying a pile of deformable material located in a channel extending lengthwise of each said adaptor member.

5. A fly screen according to claim 4 wherein the other two opposed adaptor members are provided with lengthwise channels to mount said fly screen in a fixed frame having slideways.

6. A fly screen according to claim 1 wherein said rebate of said elongate elements comprises an undercut channel and each corner cleat comprises a body formed with a groove comprising said rebate and having two limbs extending normal to each other from said body with each said limb being received in interference fit within said channel of said adjacent elongate element.

* * * * *